US007082904B2

(12) United States Patent
Takano

(10) Patent No.: US 7,082,904 B2
(45) Date of Patent: Aug. 1, 2006

(54) ENGINE COOLING SYSTEM FOR OFF-ROAD VEHICLE

(75) Inventor: Kiyohito Takano, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/057,184

(22) Filed: Feb. 15, 2005

(65) Prior Publication Data

US 2005/0183676 A1 Aug. 25, 2005

(30) Foreign Application Priority Data

Feb. 23, 2004 (JP) ..... 2004-046251

(51) Int. Cl.
*F01P 7/14* (2006.01)

(52) U.S. Cl. ..... 123/41.1; 123/41.44; 123/41.72; 123/41.82 R

(58) Field of Classification Search ..... 123/41.1, 123/41.44, 41.72, 41.82 R, 41.49
See application file for complete search history.

(56) References Cited

U.S. PATENT DOCUMENTS 6,622,666 B1 9/2003 Kuji

*Primary Examiner*—Tony M. Argenbright
*Assistant Examiner*—Katrina B. Harris
(74) *Attorney, Agent, or Firm*—Oliff & Berridge PLC

(57) ABSTRACT

An engine cooling system for cooling an engine installed in an off-road vehicle includes a coolant circulating system including a thermostat held in a thermostat case, and connecting water jackets formed in the engine and a radiator. The coolant circulating system has a metal connecting pipe held by a first bracket attached to an upper end part of a first cylinder unit of the engine. The thermostat case is an individual member separate from component members of the cylinder unit, and the thermostat case is held by the first bracket. The first bracket is formed integrally with the metal connecting pipe. When the engine is a V engine having a front cylinder unit and a rear cylinder unit, the metal connecting pipe is extended between the front and the rear cylinder unit, and is held by brackets on the front and the rear cylinder unit.

8 Claims, 5 Drawing Sheets

ENGINE COOLING SYSTEM FOR OFF-ROAD VEHICLE

BACKGROUND OF THE INVENTION

1. Field of the Invention

The present invention relates to an engine cooling system for an off-road vehicle, including a thermostat placed in a coolant circulating passage extending between the cylinder block, provided with water jackets, of an engine and a radiator.

2. Description of the Related Art

A prior art engine cooling system for an off-road vehicle has a thermostat case for holding a thermostat, held by a bracket on a body frame of the vehicle or cylinder unit of an engine included in the vehicle as mentioned in JP-A 2002-220076 or formed integrally with a component member of the engine, such as a cylinder head or a cylinder head cover.

The use of the bracket for holding the thermostat case on the body frame or on the cylinder unit increases number of parts for forming a piping system, the weight of the piping system of the cooling system and assembling work. Particularly, when the thermostat case is held on the body frame the thermostat case is spaced from the cylinders. Therefore, the thermostat is unable to respond quickly to the change of the temperature of the coolant and the operation of the thermostat is delayed. For example, the thermostat remains closed and the coolant flows slowly through water jackets of the engine after the start of the engine until the temperature of the coolant rises to a predetermined level. When the thermostat is disposed far from the engine, the thermostat senses the rise of the temperature of the coolant to the predetermined level some time after the temperature of the coolant has risen to the predetermined level, the opening operation of the thermostat is delayed. Thus, the thermostat is unable to respond quickly to the rise of the temperature of the coolant.

When the off-road vehicle is equipped with a V-type engine, the coolant flowing through water jackets in each of all the cylinder units must be collected at a single collecting part and needs to be carried from the single collecting part to the thermostat. If the thermostat case is disposed far from the V-type engine, number of parts for forming the piping system of the cooling system, the weight of the piping system and assembling work increase

SUMMARY OF THE INVENTION

Accordingly, it is an object of the present invention to provide an engine cooling system for an engine, consisting of a relatively small number of parts and capable of controlling the circulation of coolant through the engine according to the temperature of the engine in quick response to the change of the temperature of the engine.

An engine cooling system for cooling an engine installed in an off-road vehicle, includes a coolant circulating system connecting a water jacket in the engine and a radiator, the coolant circulating system including a thermostat held in a thermostat case provided between a coolant outlet of the water jacket and a coolant inlet of the radiator, and a connecting pipe for fluidly connecting the water jacket of the engine and the thermostat case; wherein the connecting pipe is held by a bracket attached to an upper end part of a cylinder unit, the thermostat case is an individual member separate from component members of the cylinder unit, and the thermostat case is held by the bracket.

Since both the connecting pipe and the thermostat case are held by the bracket fastened to an upper part of the cylinder unit, any additional part for holding the thermostat case is not needed. Consequently, the engine cooling system needs a relatively small number of parts, and can reduce assembling work and weight.

Since the thermostat case is disposed on the upper part of the engine, the thermostat case can be arranged near the cylinder unit. Therefore, the thermostat is able to respond quickly to the rise of coolant temperature at the start of the engine.

Preferably, the connecting pipe is formed by a metal.

The use of the metal pipe enables the omission of rubber hoses and hose bands and assembling work can be thereby reduced.

In the engine cooling system according to the present invention, it is preferable that the bracket is formed integrally with the connecting pipe.

The formation of the bracket integrally with the metal pipe facilitates assembling work.

In the engine cooling system according to the present invention, when the engine is a multicylinder engine having a plurality of cylinder units, such as a V-type engine, it is preferable that the connecting pipe is extended between first and second cylinder units, and has a first end held on the first cylinder unit by the bracket and a second end held on the second cylinder unit by another bracket.

It is preferable that the second end of the connecting pipe is connected to the coolant outlet of the second cylinder unit, the first end of the connecting pipe is connected to an inlet of the thermostat, the connecting pipe has an expanded part near the thermostat case, and a branch pipe is extended between the expanded part of the connecting pipe and the coolant outlet of the first cylinder unit.

Since the metal pipe is provided with the expanded part and the branch pipe is connected to the expanded part, the flows of the coolant from the two cylinder units join together in the expanded part of the metal pipe and the flows of the coolant are able to flow smoothly.

Preferably, the engine is a V-type engine in which the first cylinder unit is forward tilted and the second cylinder unit is reward tilted.

Preferably, the thermostat is provided at a position being above the first cylinder and being lower than that of the coolant inlet of the radiator.

Preferably, the connecting pipe extends downwardly from the inlet of the thermostat to a coolant outlet of the second cylinder.

An engine cooling system according to a second aspect of the present invention for cooling an engine installed in an off-road vehicle includes a coolant circulating system including a thermostat held in a thermostat case, and connecting water jackets formed in the engine and a radiator; wherein the engine has tilted cylinder units, the thermostat case is an individual member held on an upper end part of the tilted cylinder unit, and the radiator is provided with a filling opening at a level higher than that of the thermostat. In this structure, since the thermostat case is disposed on the upper part of the engine, the thermostat case can be arranged near the cylinder unit. Therefore, the thermostat is able to respond quickly to the rise of coolant temperature at the start of the engine.

Further, air in the coolant circulating structure of the cooling system can be released easily.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Off-road Vehicle and Engine

Figure 1:
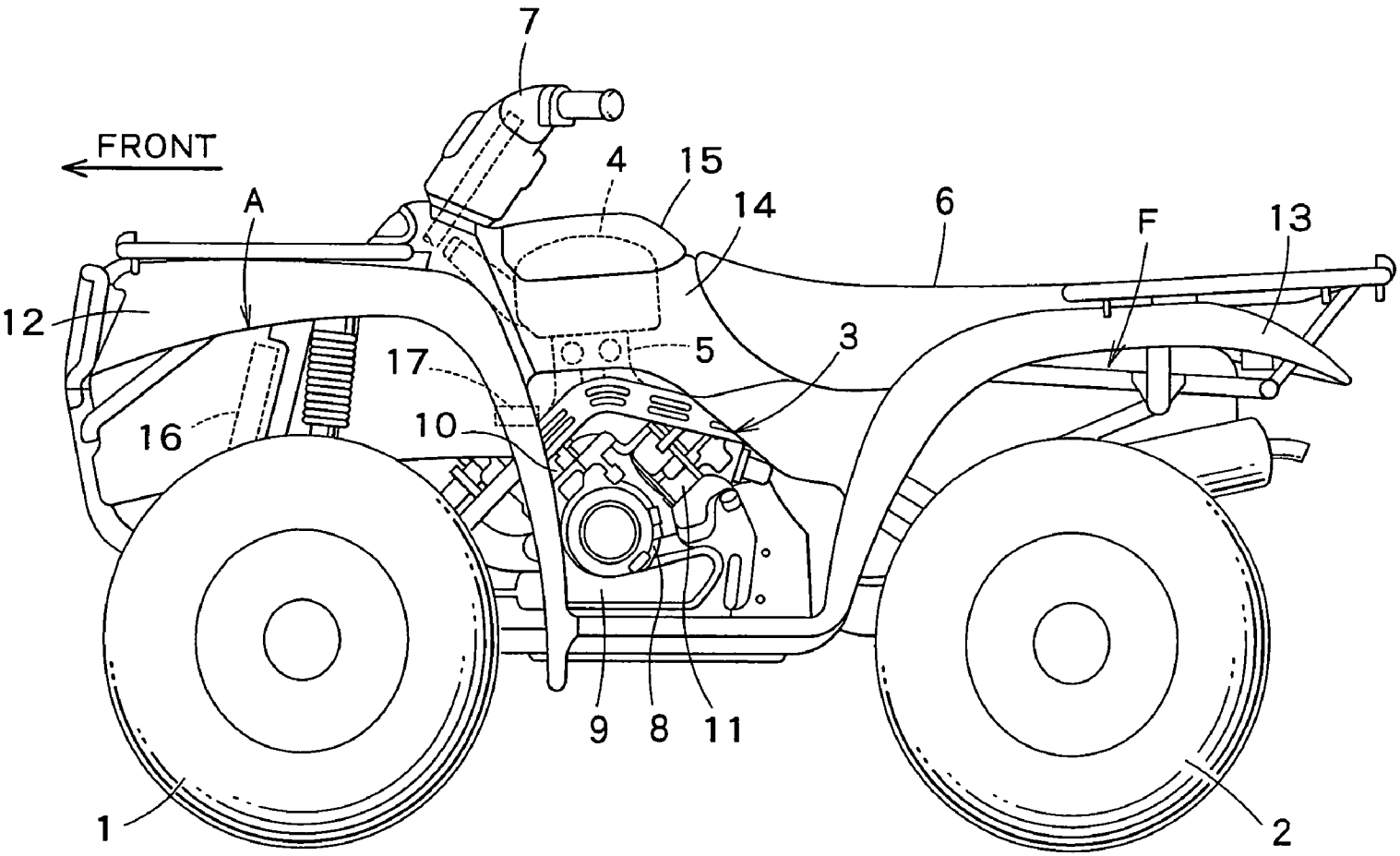
FIG. 1 is a side elevation of an off-road vehicle including an engine cooling system in a preferred embodiment according to the present invention taken from the left side of the off-road vehicle.

Referring to FIG. 1 showing the left side of a straddle-type four-wheel all-train vehicle, which is one of the off road vehicle having a water-cooled engine provided with a cooling system in a preferred embodiment according to the present invention, the all-train vehicle has a body frame F, right and left front wheels 1 suspended from a front part of the body frame F, right and left rear wheels 2 suspended from a rear part of the body frame F, a V-2 engine 3 mounted on the body frame at a position between the front wheels 1 and the rear wheels 2, and a steering handle 7 disposed above a front end part of the engine 3. A carburetor 5 and an air cleaner 4 mounted on the carburetor are disposed above a V-bank of the engine. The V-2 engine 3 has a forward tilted front cylinder unit 10, a rearward tilted rear cylinder unit 11, and a crankcase joined to the lower ends of the front cylinder unit 10 and the rear cylinder unit 11. A radiator 16 is supported on a front part of the body frame F. A straddle seat 6 is supported on a rear part of the body frame F. A coolant reservoir tank 9 is attached to the left side surface of the crankcase 8 of the engine 3.

Figure 2:
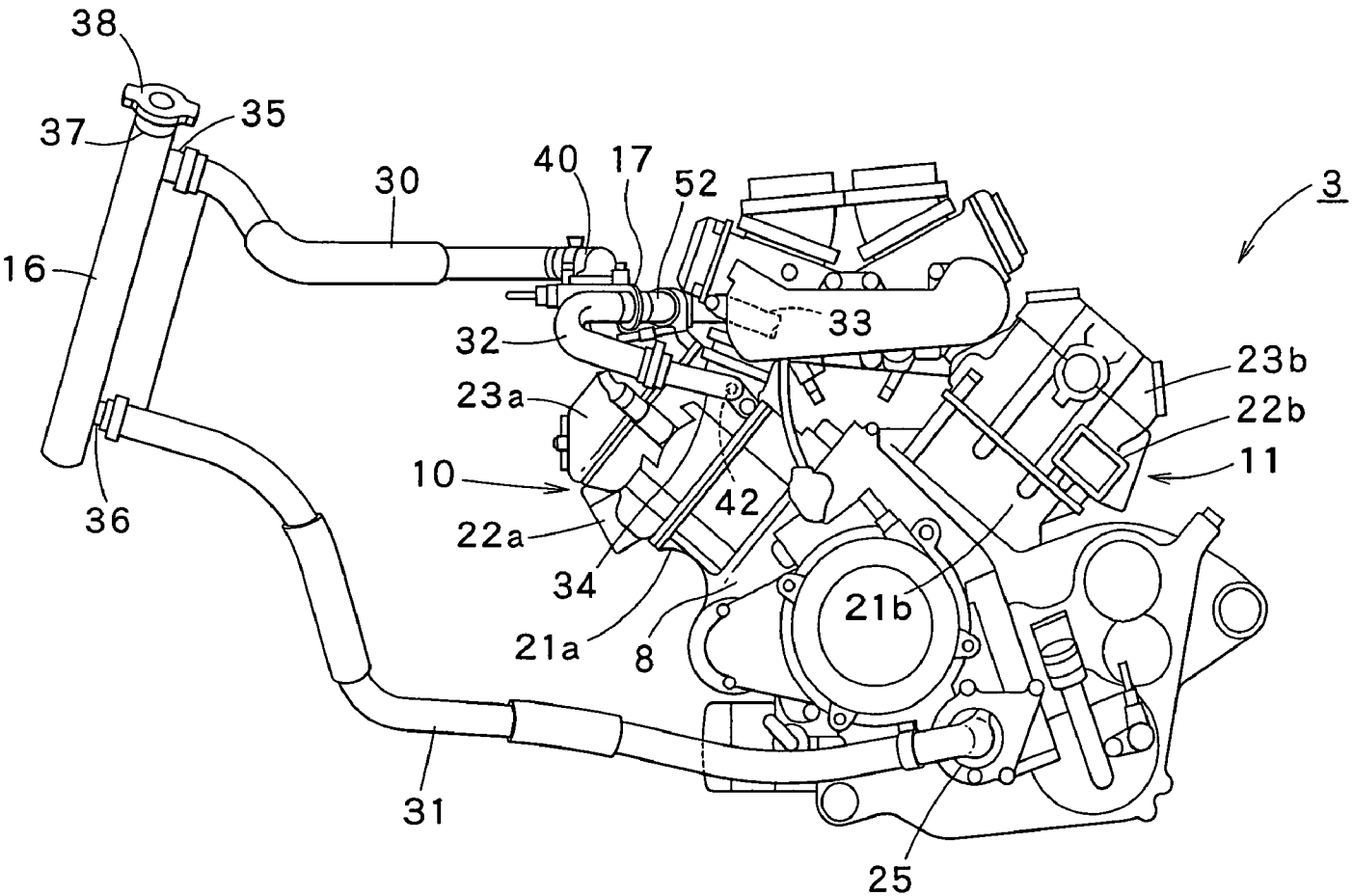
FIG. 2 is a side elevation of an engine, a radiator and pipings of the engine cooling system included in the off-road vehicle shown in FIG. 1.

Referring to FIG. 2, showing the engine 3 and the radiator 16, the front cylinder unit 10 of the engine 3 includes a cylinder block 21*a*, a cylinder head 22*a* and a cylinder head cover 23*a*. The rear cylinder unit 11 includes a cylinder block 21*b*, a cylinder head 22*b* and a cylinder head cover 23*b*. The cylinder blocks 21*a* and 21*b*, the cylinder heads 22*a* and 22*b*, and the cylinder head covers 23*a* and 23*b* of the front cylinder unit 10 and the rear cylinder unit 11 are the same parts, respectively, and the front cylinder unit 10 and the rear cylinder unit 11 are in inverse relation to each other with respect to a lateral direction.

Cooling System

Referring to FIG. 2, the cooling system includes the radiator 16 disposed in front of the engine 3, a water pump 25 attached to the left end surface of the crankcase 8, a thermostat case 17 disposed near the upper end of the forward tilted front cylinder unit 10, a coolant circulating structure including water jackets and coolant passages formed in the engine 3, the coolant reservoir tank 9, coolant hoses 30, 31 and 32, a connecting pipe 33 formed by metal extended between the cylinder units 10 and 11, and a metal joint pipe 34.

Here, the connecting pipe 33 may be wholly formed by a metal or may be partially formed by materials other than a metal. In some cases, the connecting pipe 33 may be wholly formed by materials other than a metal such as resin.

A coolant inlet pipe 35 and a coolant outlet pipe 36 project rearward from upper and lower end parts, respectively, of a back surface of the radiator 16. A radiator filler neck 37 is attached to an upper left-hand part of the radiator 16. The respectively levels of the coolant inlet pipe 35 and the radiator filler neck 37 are higher than that of the upper end of the thermostat case 17. The coolant inlet pipe 35 of the radiator 16 is connected to a coolant outlet 40 formed in the upper end of the thermostat case 17 by the coolant hose 30. The coolant outlet pipe 36 of the radiator 16 is connected to the suction port of the water pump 25 by the coolant hose 31. The discharge port of the water pump 25 is connected to the water jackets of the cylinder units 10 and 11 by the coolant passage formed in the crankcase 8. A coolant outlet 42 is formed in the left side surface of the cylinder head 22*a* of the front cylinder unit 10. The coolant outlet 42 of the front cylinder unit 10 is connected to a front end part of the metal connecting pipe 33 by the coolant hose 32 and a metal branch pipe 52 provided on the connecting pipe 33.

Figure 3:
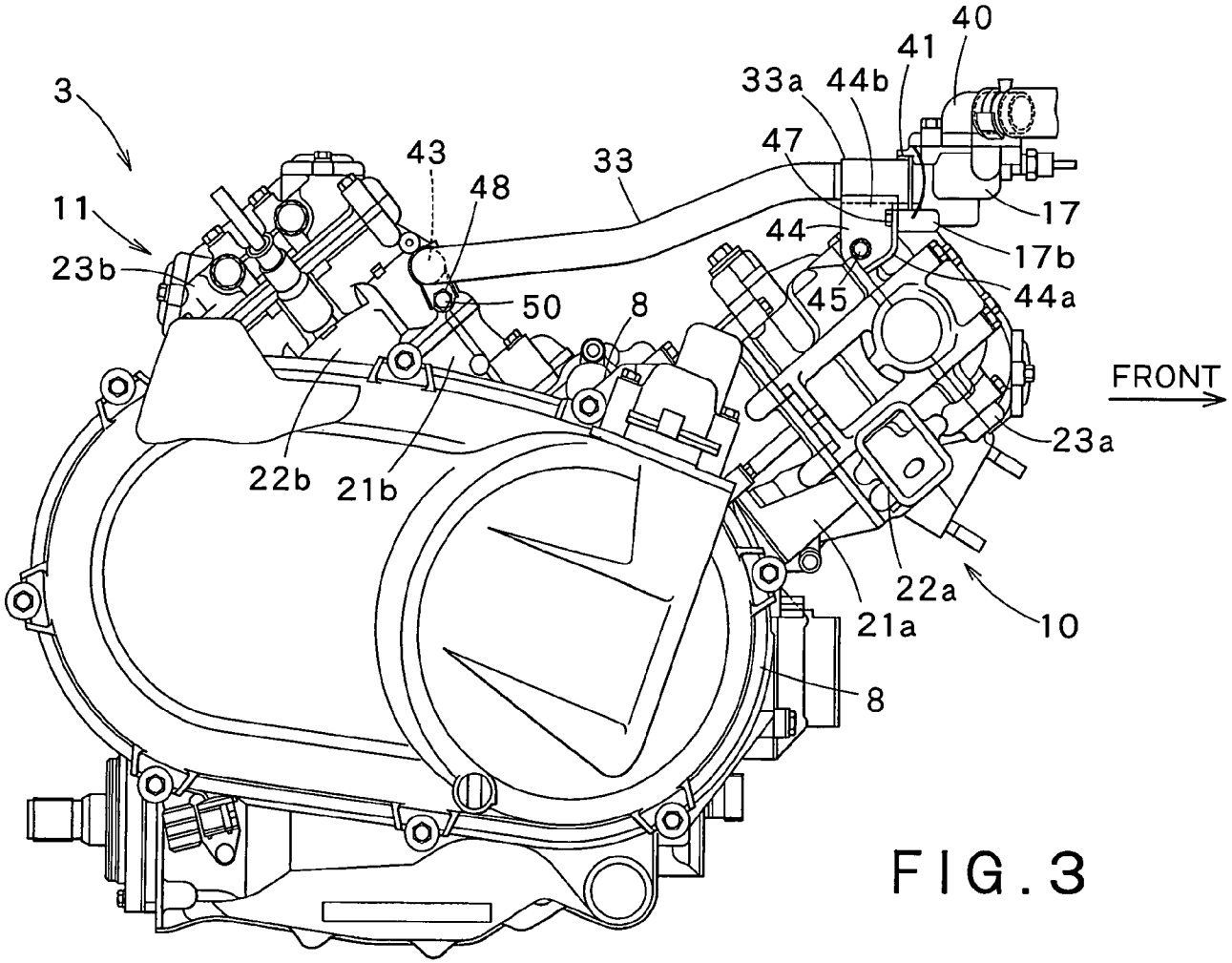
FIG. 3 is a side elevation of the engine of the off-road vehicle shown in FIG. 1 taken from the right side of the engine.

Referring to FIG. 3, a coolant outlet 43 is formed in the right side surface of the cylinder head 22*b* of the rear cylinder unit 11. The coolant outlet 43 is connected to a coolant inlet 41 formed in a rear end lower part of the thermostat case 17 through the metal connecting pipe 33 with the coolant outlet 42 of the front cylinder unit 10.

Metal Pipe and Thermostat Case

Referring to FIG. 3, the metal connecting pipe 33 is extended so as to slope down rearward between the cylinder units 10 and 11. A first bracket 44 and a second bracket 48 are welded to the front and the rear end part of the metal pipe 33, respectively, so as to extend downward. The first bracket 44 is detachably fastened to the right side surface of an upper end part of the cylinder head cover 23*a* of the front cylinder unit 10 with a bolt 45. A front part of the first bracket 44 is bent to form a thermostat case holding part 44*a* integrally provided with a reinforcing rib 44*b*. A support part 17*b* at the lower end of the thermostat case 17 is detachably fastened to the thermostat case holding part 44*a* with a bolt 47. The second bracket 48 has a U-shaped cross section. The second bracket 48 is fastened to the right side surface of a front part of the cylinder head 22*b* of the rear cylinder unit 11 with a bolt 50.

Figure 5:
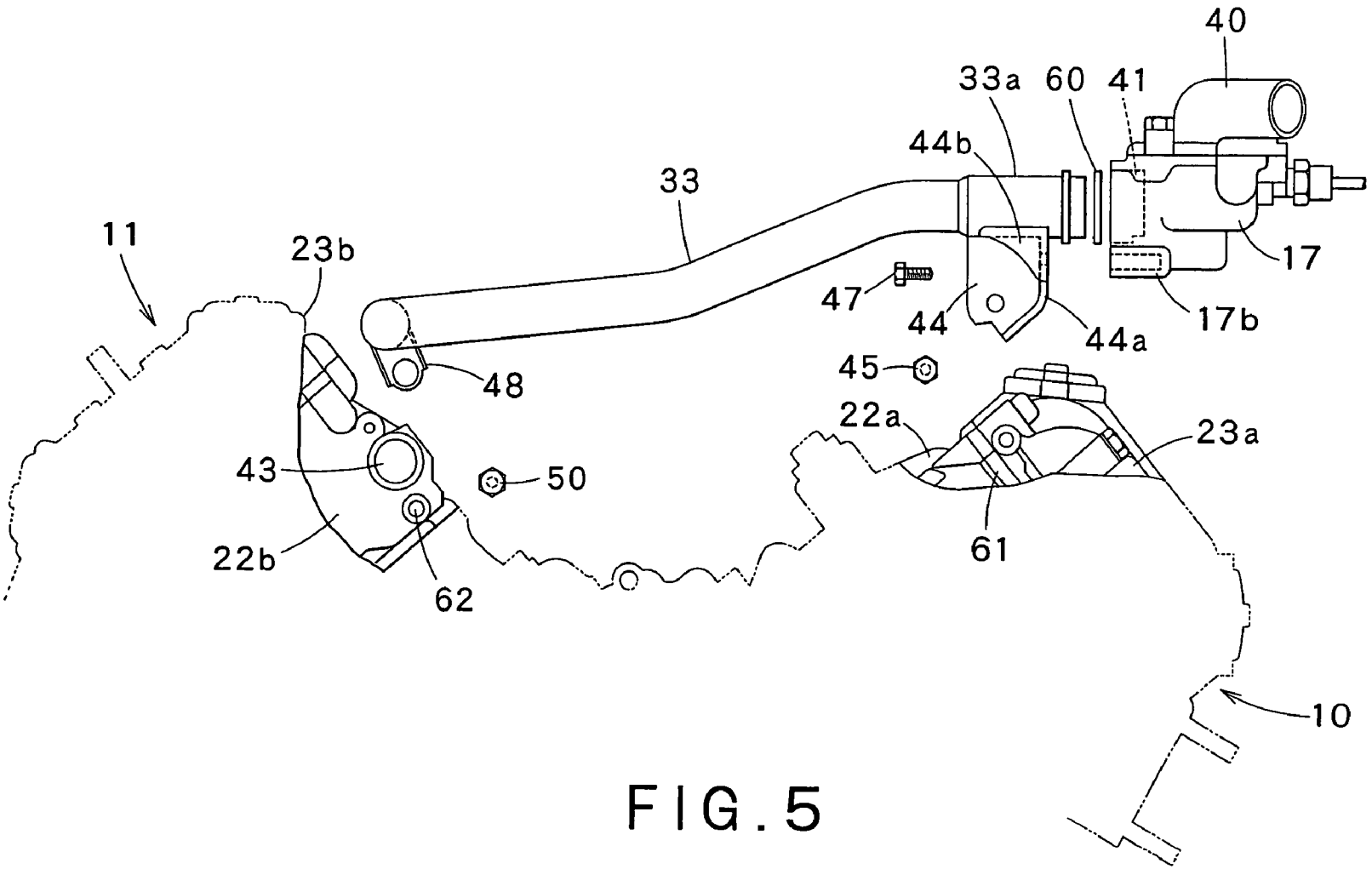
FIG. 5 is a side elevation of the connecting pipe and the thermostat case separated from the engine taken from the right side of the engine.

FIG. 5, shows the metal connecting pipe 33 and the thermostat case 17 disconnected from the engine 3. As shown in FIG. 5, a threaded hole 61 is formed in the right side surface of the cylinder head cover 23*a* of the front cylinder unit 10, and a threaded hole 62 is formed in the right side surface of the cylinder head 22*b* of the rear cylinder unit 11. The bolts 45 and 47 are screwed in the threaded holes 61 and 62 to fasten the first bracket 44 to the cylinder head cover 23*a* and to fasten the second bracket 48 to a part of the right side surface of the rear cylinder head 22*b* near the coolant outlet 53, respectively. The metal connecting pipe 33 has an expanded part 33*a* in its front part. An open front end part of the expanded part 33*a* is fitted in the coolant inlet 41 of the thermostat case 17 with an O ring 60 held between the open front end part of the expanded part 33*a* and the thermostat case 17.

Figure 4:
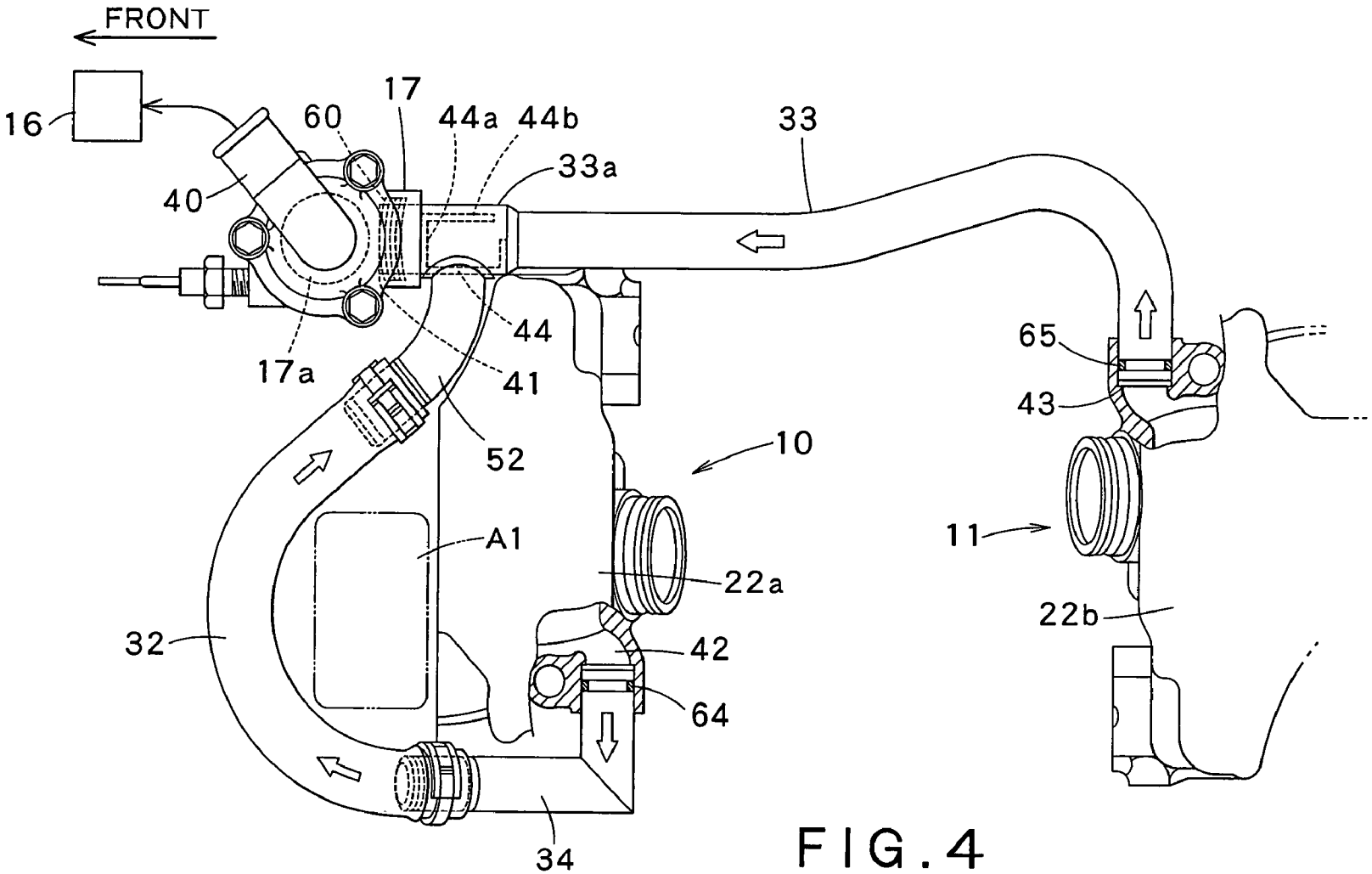
FIG. 4 is a plan view of assistance in explaining an arrangement of a connecting pipe and a thermostat case.

FIG. 4 shows the metal connecting pipe 33 and the associated parts in a plan view. The metal branch pipe 52 is formed integrally with the expanded part 33*a* so as to project leftward from the expanded part 33*a* of the metal connecting pipe 33. The hose 32 connected to the metal branch pipe 52 is extended in front of a tappet inspection opening A1 formed in the front cylinder unit 10 to a position near the left side of the front cylinder unit 10, and is connected to a front end part of the L-shaped metal joint pipe 34. A rear end part of the metal joint pipe 34 is fitted in the coolant outlet 42 of the front cylinder unit 10 with an O ring 64 held between the rear end part of the metal joint pipe 34 and the coolant outlet 42.

A thermostat 17*a* is held in the thermostat case 17. The thermostat 17*a* closes when coolant temperature is lower than a predetermined temperature and opens when coolant temperature is not lower than the predetermined temperature. The thermostat 17*a* is provided with an air vent to permit air to flow from its lower side into its upper side while the thermostat 17*a* is closed.

Procedure for Assembling Thermostat Case and Metal Connecting Pipe

Referring to FIG. 5, the metal connecting pipe 33 is placed above the right side of the engine 3, the rear end of the metal connecting pipe 33 is fitted in the coolant outlet 43 formed in the right side surface of the rear cylinder unit 11, and the second bracket 48 is fastened to the front right side surface of the cylinder head 22*b* with the bolt 50. The, the first bracket 44 welded to the front end part of the metal pipe 33 is fastened to the right side surface of the upper part of the cylinder head cover 23*a* of the front cylinder unit 10 with the bolt 45. Thus opposite ends of the metal connecting pipe 33 are held on the cylinder units 10 and 11 by the brackets 44 and 48 and the metal connecting pipe 33 is extended between the front cylinder unit 10 and the rear cylinder unit 11. The front end part of the metal connecting pipe 33 is fitted in the coolant inlet 41 of the thermostat case 17 with the O ring 60 held between the front end part of the metal connecting pipe 33 and the thermostat case 17, and the support part 17*b* of the thermostat case 17 is fastened to the thermostat case holding part 44*a* of the first bracket 44 with the bolt 47 before or after attaching the metal connecting pipe 33 to the front cylinder unit 10 and the rear cylinder unit 11. Thus the thermostat case 17 is supported on the front cylinder unit 10 by the first bracket 44 welded to the metal connecting pipe 33.

Since the cylinder blocks 21*a* and 21*b*, the cylinder heads 22*a* and 22*b*, and the cylinder head covers 23*a* and 23*b* of the front cylinder unit 10 and the rear cylinder unit 11 are the same parts, respectively, the engine 3 can be assembled by disposing the front cylinder unit 10 and the rear cylinder unit 11 in inverse relation to each other with respect to a lateral direction. Thus those parts are easy to manufacture and to manage.

Operation

Referring to FIG. 2, while the coolant temperature is lower than the predetermined temperature after the start of the engine 3, the thermostat 17*a* held in the thermostat case 17 remains closed. Consequently, the coolant circulates scarcely and flows slowly in the water jackets. The thermostat 17*a* opens upon the rise of the temperature of the coolant in the water jackets beyond the predetermined temperature. Then the coolant discharged through the coolant outlet 43 of the rear cylinder unit 11 into the metal connecting pipe 33 flows from through the expanded part 33*a* and the coolant inlet 41 into the thermostat case 17. The coolant discharged through the coolant outlet 42 of the front cylinder unit 10 into the metal joint pipe 34 flows through the hose 32 and the branch pipe 52 into the expanded part 33*a*. Thus the flows of the coolant from the front cylinder unit 10 and the rear cylinder unit 11 join together in the expanded part 33*a* of the metal connecting pipe 33 and the coolant flows from the expanded part 33*a* into the thermostat case 17. Since the flows of the coolant from the front cylinder unit 10 and the rear cylinder unit 11 join together in the expanded part 33*a*, the stagnation or the reverse flow of the coolant can be suppressed.

The coolant flowed through the lower coolant inlet 41 into the thermostat case 17 flows through the open thermostat 17*a*, the upper coolant outlet 40, the hose 30 and the coolant inlet pipe 35 attached to the upper end of the radiator 16 into the radiator 16. The coolant is cooled while the same flows down in the radiator 16. The cooled coolant is sucked through the lower coolant outlet 36 and the hose 31 into the water pump 25. The water pump 25 pumps the cooled coolant into the water jackets of the engine 3. Thus the coolant is circulated through the coolant circulating passage including the radiator 16 to cool the engine 3.

The quantity of the coolant is inspected before the engine 3 is used for the first time after shipping. If the coolant is insufficient, a radiator pressure cap 38 is removed from the radiator filler neck 37, and the engine is replenished with additional coolant by pouring the additional coolant through the radiator filler neck 37 into the radiator 16. Normally, the thermostat 17*a* is closed when the additional coolant is poured through the radiator filler neck 37 into the radiator 16. Therefore, most part of the additional coolant is supplied into the radiator 16 and flows through the lower hose 31 and the water pump 25 into the water jackets of the engine 3. While the additional coolant is being poured into the radiator 16, air remaining in the water jackets of the cylinder units 10 and 11 is forced into the thermostat case 17 through the metal connecting pipe 33, the connecting pipe 34, the hose 32 and the branch pipe 52 shown in FIG. 4. Then the air is forced to flow through the air bent of the thermostat 17*a*, the hose 30 shown in FIG. 2 and the coolant inlet pipe 35 into the radiator 16 and is purged away together with air remaining in the radiator 16 through the radiator filler neck 37.

Although the invention has been described as applied to the four-wheel all-train vehicle equipped with the V-2 engine, the invention is applicable to other type off-road vehicles equipped with any one of various types of engines having any number of cylinders.

Obviously, many changes and variations are possible in the preferred embodiment described herein and it is therefore to be understood that the present invention may be practiced otherwise than as specifically described herein without departing from the scope and spirit thereof.

What is claimed is:

1. An engine cooling system for cooling an engine installed in an off-road vehicle, said engine cooling system comprising a coolant circulating system connecting a water jacket in the engine and a radiator, the coolant circulating system including a thermostat held in a thermostat case provided between a coolant outlet of the water jacket and a coolant inlet of the radiator, the thermostat case being an individual member separate from component members of the cylinder unit, and a connecting pipe for connecting the coolant outlet of the water jacket of the engine and a coolant inlet of the thermostat case;

wherein the connecting pipe is held by a first bracket attached to an upper section of a cylinder unit of the engine, and the thermostat case is held with the connecting pipe by the first bracket.

2. The engine cooling system according to claim 1, wherein at least a part of the connecting pipe is formed by a metal.

3. The engine cooling system according to claim 2, wherein the bracket is formed integrally with the connecting pipe.

4. The engine cooling system according to claim 2, wherein the engine has a plurality of cylinder units, the connecting pipe is extended between first and second cylinder units, and has a first end held on the first cylinder unit by the first bracket and a second end held on the second cylinder unit by a second bracket, wherein the engine is a V-type engine in which the first cylinder unit is forward titled and the second cylinder unit is reward titled, and the thermostat is provided at a position being above the first cylinder unit and being lower than that of the coolant inlet of the radiator.

5. The engine cooling system according to claim 4, wherein the second end of the connecting pipe is connected to the coolant outlet of the water jacket of the second cylinder unit, the first end of the connecting pipe is connected to the inlet of the thermostat, the connecting pipe has an expanded part near the thermostat case, coolant from the first cylinder unit and the second cylinder unit being joined together in the expanded part, and the connecting pipe has a branch pipe for connecting the expanded part of the connecting pipe with the coolant outlet of the water jacket of the first cylinder unit.

6. The engine cooling system according to claim 5, wherein the connecting pipe extends downwardly from the inlet of the thermostat to the coolant outlet of the second cylinder.

7. An engine cooling system according to claim 1, wherein the engine has tilted cylinder units, the thermostat case is an individual member held on an upper end part of the tilted cylinder unit, and the radiator is provided with a filling opening at a level higher than that of the thermostat.

8. An engine cooling system according to claim 1, wherein the connecting pipe is formed by a metal.

* * * * *